US005649799A

United States Patent [19]

Constantine et al.

[11] Patent Number: 5,649,799

[45] Date of Patent: Jul. 22, 1997

[54] APPARATUS FOR CONNECTING RING-BINDER WITH FOLDER

[75] Inventors: Theo A. Constantine, Greenwich; Fred W. Berg, Stamford, both of Conn.

[73] Assignee: C-Lock, Inc., Stamford, Conn.

[21] Appl. No.: 683,814

[22] Filed: Jul. 16, 1996

[51] Int. Cl.[6] ..... B42D 3/00

[52] U.S. Cl. ..... 412/19; 412/43; 281/36; 281/29

[58] Field of Search ..... 412/1, 4, 9, 18, 412/19, 43; 281/36, 29; 402/73, 70, 26

[56] References Cited

U.S. PATENT DOCUMENTS

| | | | |
|---|---|---|---|
| 1,496,171 | 6/1924 | Roe et al. | 412/43 |
| 3,137,874 | 6/1964 | Hildmann et al. | 281/36 X |
| 4,722,628 | 2/1988 | Rager | 281/36 X |

*Primary Examiner*—Willmon Fridie, Jr.
*Attorney, Agent, or Firm*—Lackenbach Siegel Marzullo Aronson & Greenspan, PC

[57] ABSTRACT

An apparatus for securing a binder to the spine of a cover with rivets. A pair of rivet supports holding two rivets in a support position over a pair of anvils is movable between release and support positions with a biasing spring returning the rivet support to the release position. A drive shaft moves the pair of rivets in a downward vertical direction terminating in a downward stroke so as to drive the plain ends of the rivets through the cover spine and the binder. Drive linkage connected to a horizontal rotatable drive bar activated by a lever activates the drive shafts to a limited lowered position and a raised position. The anvils receive the plain ends of the rivets and make the plain ends of the rivets into second heads upon termination of the downward stroke of the drive shafts whereby the rivets secure the binder and the cover spine. Keepers prevent lateral and transverse movement of the binder and and cover.

35 Claims, 11 Drawing Sheets

APPARATUS FOR CONNECTING RING-BINDER WITH FOLDER

FIELD OF THE INVENTION

This invention relates generally to the field of ring binders and particularly to an apparatus for mounting a ring binder to a folder for use in short-run production. One such ring binder is shown in U.S. Pat. No. Des. 356, 112, granted Mar. 7, 1995.

BACKGROUND OF THE INVENTION

A ring binder typically holds sheets of a common form of notebook paper with typically two or three perforated ring apertures. A like number of rings are secured to a binder central strip that in turn is secured to the spine of a folder, or cover, having front and rear sides, the totality of binder strip, ring structure, and folder comprising the ring binder. The rings can be rotated to open and closed positions. In the open position a number of the perforated sheets are slid onto the rings and the rings then rotated to the closed position so as to make a notebook or a book. One type of ring binder includes a binder strip secured to the spine of a folder and a separate ring structure that is separately mounted to the binder strip. Another type of ring binder includes a binder with a binder strip unitary with a ring structure both secured to the spine of a folder, the unitary binder and ring structure being made of a flexible plastic with the ring structures being individually movable, or flexed, between the open and closed positions.

The securing of a binder strip with a separate ring structure with a folder or a unitary binder strip and ring structure with a folder is generally done by a mass assembly apparatus that is unsuitable to short-run production using offset-printed custom folders.

SUMMARY OF THE INVENTION

Accordingly, it is an object of the present invention to provide a small, desk-top type of apparatus for securing a binder strip to the spine of a folder.

It is an object of the present invention to provide a small, desk-top type of apparatus for securing a unitary binder strip and ring structure to the spine of a folder.

It is a further object of the present invention to provide an apparatus for securing a binder strip to a folder that is suitable for on-demand, short-run production with offset printed custom covers.

It is a further object of the present invention to provide an apparatus for securing a unitary binder strip and ring structure to a folder that is suitable for on-demand, short-run production with offset printed custom covers.

It is a further object of the present invention to provide a desk-top apparatus for assembling a binder strip to a folder that can be accomplished in a small number of assembly steps that are suitable for on-demand, short-run production.

In accordance with these and other objects that will become apparent in the course of this disclosure, there is provided an apparatus for securing a binder to the spine of a cover with rivets. A pair of rivet supports holding two rivets in a support position over a pair of anvils is movable between release and support positions with a biasing spring returning the rivet support to the release position. A drive shaft moves the pair of rivets in a downward vertical direction terminating in a downward stroke so as to drive the plain ends of the rivets through the cover spine and the binder. Drive linkage connected to a horizontal rotatable drive bar activated by a lever activates the drive shafts to a limited lowered position and a raised position. The anvils receive the plain ends of the rivets and make the plain ends of the rivets into second heads upon termination of the downward stroke of the drive shafts whereby the rivets secure the binder and the cover spine. Keepers prevent lateral and transverse movement of the binder and and cover.

The present invention can be better understood and the objects and and important features, other than those specifically set forth above, will become apparent when consideration is given to the following details and description, which when taken in conjunction with the annexed drawings, describes, discloses, illustrates, and shows preferred embodiments or modifications of the present invention and what is presently considered and believed to be the best mode of practice in the principles thereof.

A BRIEF STATEMENT OF THE FIGURES

DETAILED DESCRIPTION OF THE PREFERRED EMBODIMENT

*Reference is now made in detail to the drawings wherein the same numerals refer to the same or similar elements throughout.

Figure 1:
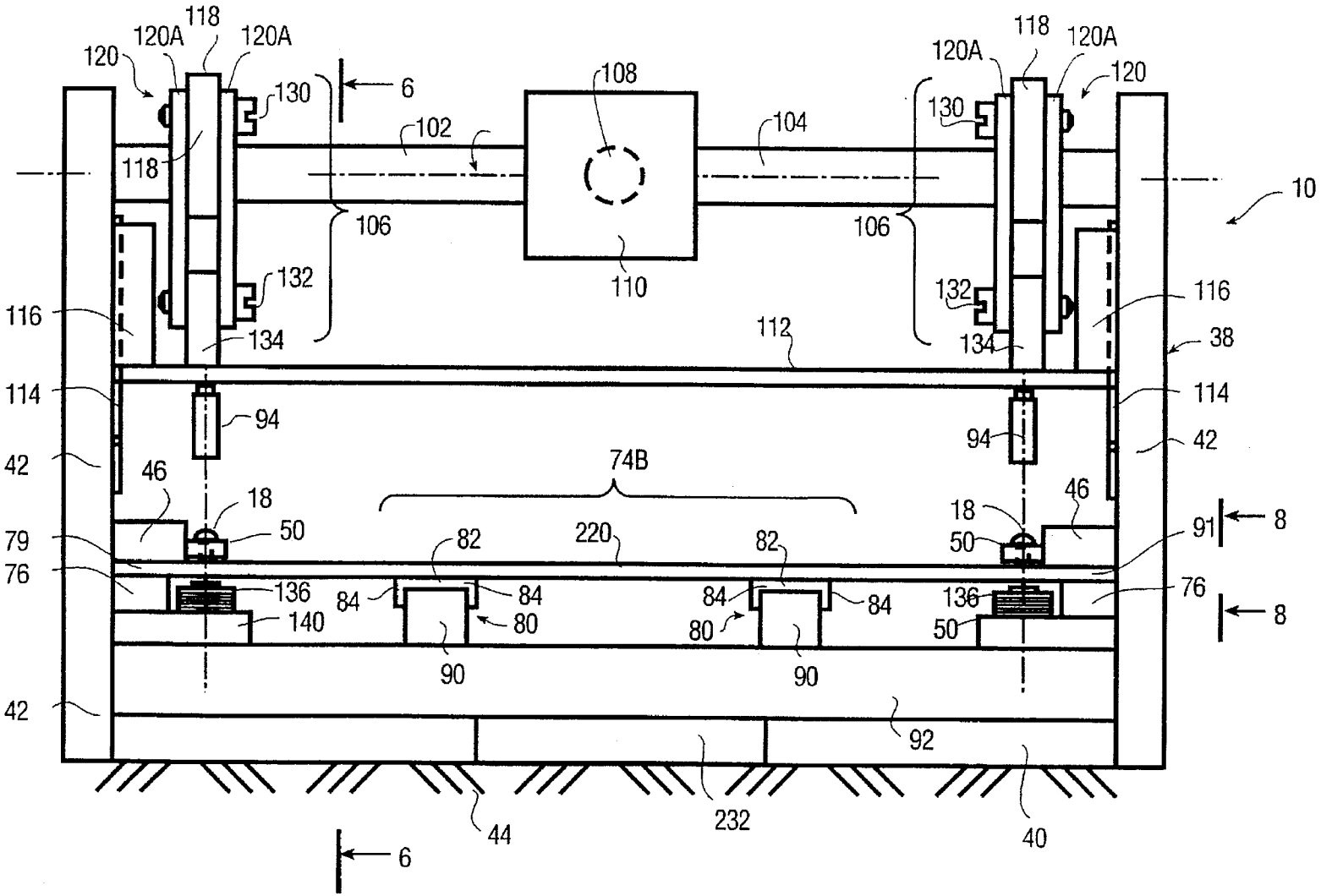
FIG. 1 is a front, or operator side, elevational view of the present assembly apparatus.
Figure 2:
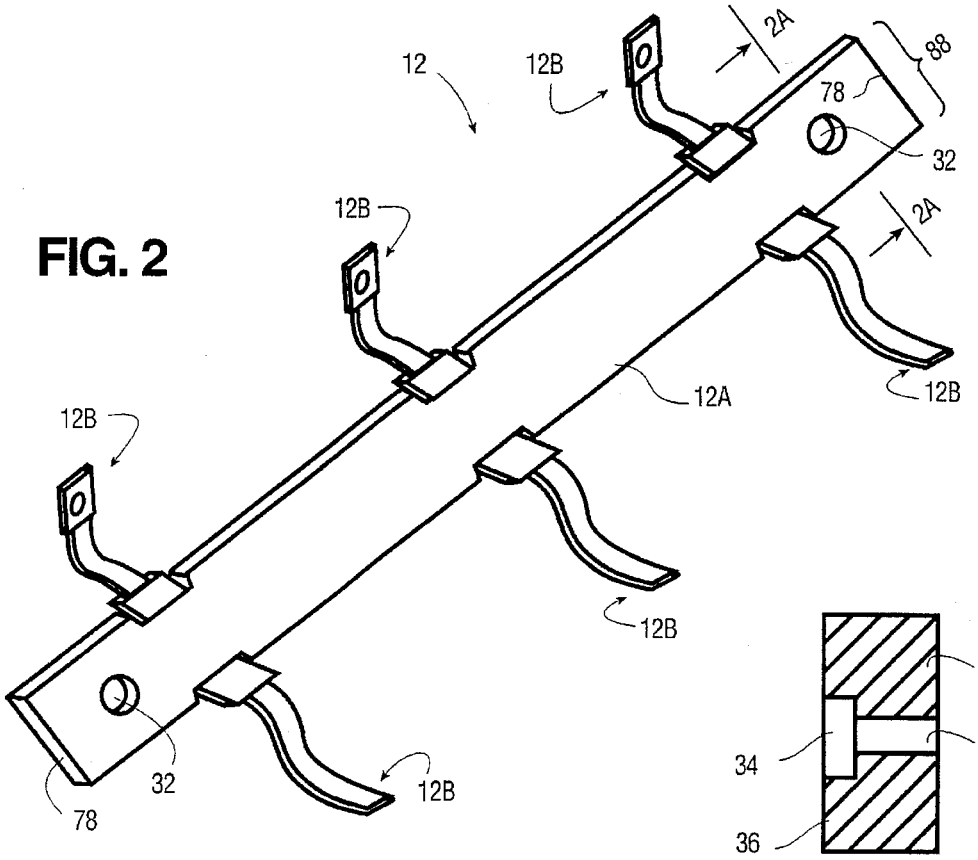
FIG. 2 is a perspective view of a unified binder and ring assembly.
Figure 2A:
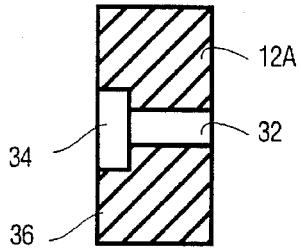
FIG. 2A is a sectional view taken through plane 2A—2A of FIG. 2.
Figure 3:
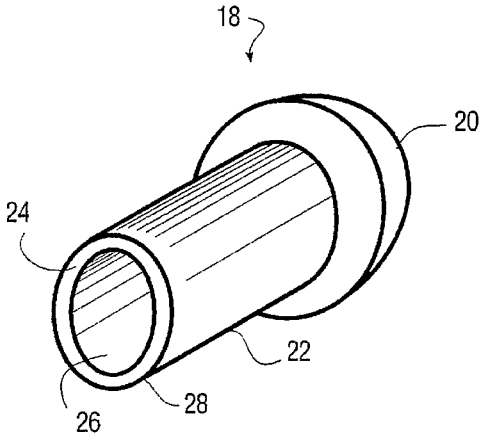
FIG. 3 is a perspective view of a rivet.
Figure 4:
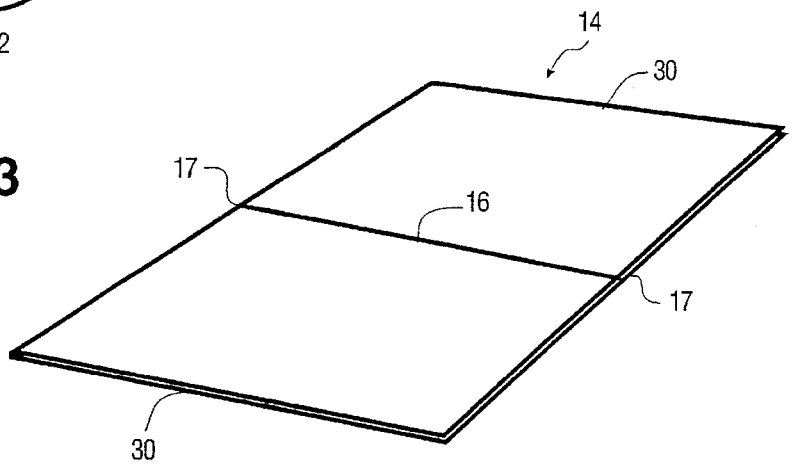
FIG. 4 is a perspective view of a cover.
Figure 9A:
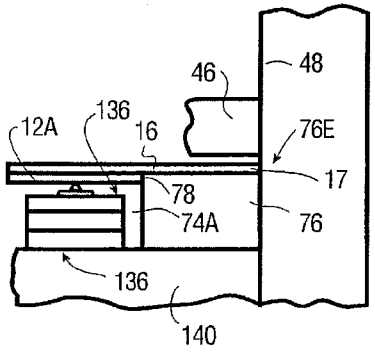
FIG. 9A is an isolated side view showing the recess for receiving the end of the cover.
Figure 9:
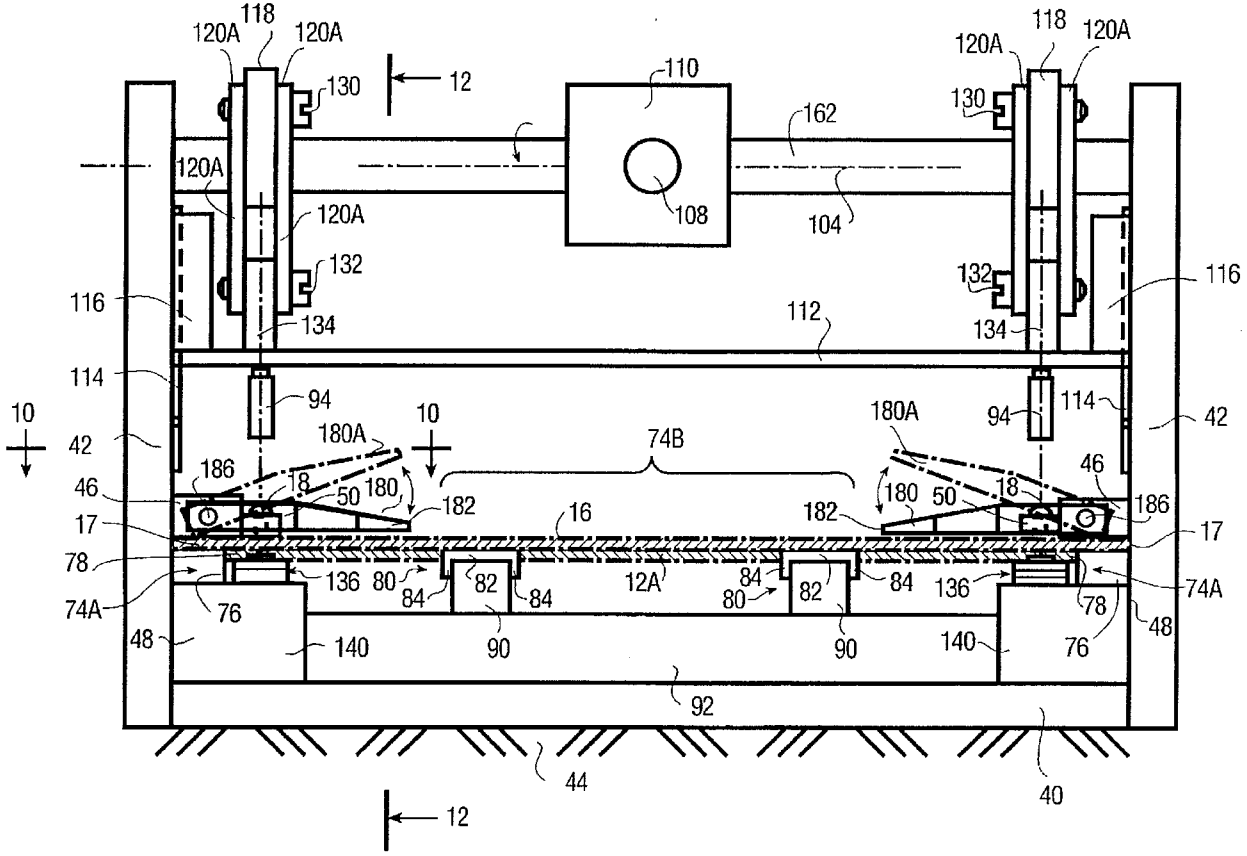
FIG. 9 is a rear view of the apparatus opposite to the view shown in FIG. 1 without the mounting table with a cross-sectional phantom view of the unitary binder and ring assembly positioned under a cross-sectional phantom view of the spine of a cover and further including optional hold-down plates.

An apparatus 10 for securing, or connecting, a unitary binder and ring assembly 12 to a cover 14, in particular to the cover spine 16, by means of two compressible rivets 18 is best illustrated in FIGS. 1 and 9. Each rivet 18 includes a rivet convex head 20, a rivet cylindrical shank 22 including a shank cylindrical wall 24 defining a shank hollow 26, and a rivet plain end 28 opposite to rivet head 20. Binder and ring assembly 12 is shown in FIG. 2, cover 14 is shown in FIG. 3, and rivet 18 is shown in FIG. 4. Cover 14 includes opposed cover sides 30 between which extends cover spine 16.

Binder and ring assembly 12 comprises a binder portion 12A and a three-ring portion 12B. Binder and ring assembly 12 includes two apertures 32 defined along the binder and ring assembly spaced equidistant from ends 12C of binder portion 12A. Three-ring portion 12B is shown in an open position but each ring can be individually closed or opened. Apertures 32 extend through the thickness of binder portion 12A for passing rivets 18 during the mounting operation. Binder portion 12A defines a countersink 34 around each aperture 32 on the outer side 36 of binder portion 12A. Ring portions 12B are for extending through three-holed paper (not shown).

Apparatus 10 includes a support structure 38 that includes a horizontal base 40 and a pair of opposed side support walls 42 connected to and extending vertically from the opposed ends of base 40, which rests upon an external support surface 44 such as the surface of a desk.

Figure 8:
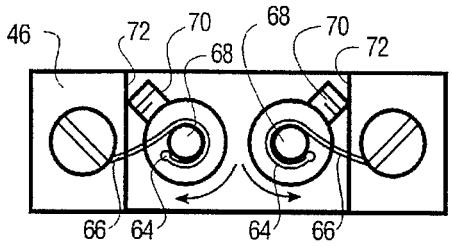
FIG. 8 is an isolated rear view of the rivet support taken through line 8—8 of FIG. 1 showing the torsion spring.
Figure 12:
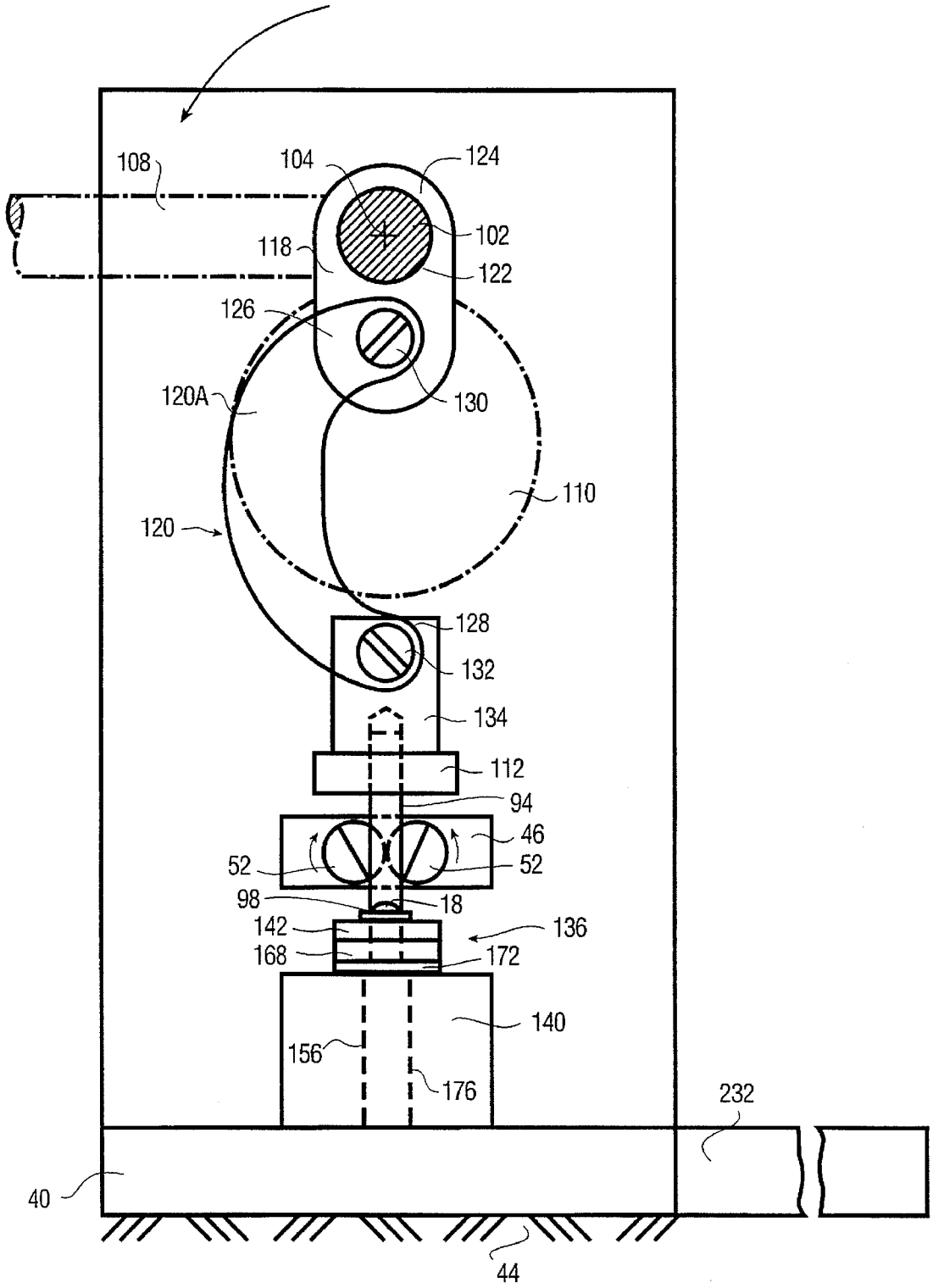
FIG. 12 is a view analogous to the view of FIG. 6 with the drive mechanism and the drive linkage in a lowered position and the rivet having been press mounted to the unified binder and ring assembly and cover spine against the anvil.
Figure 13:
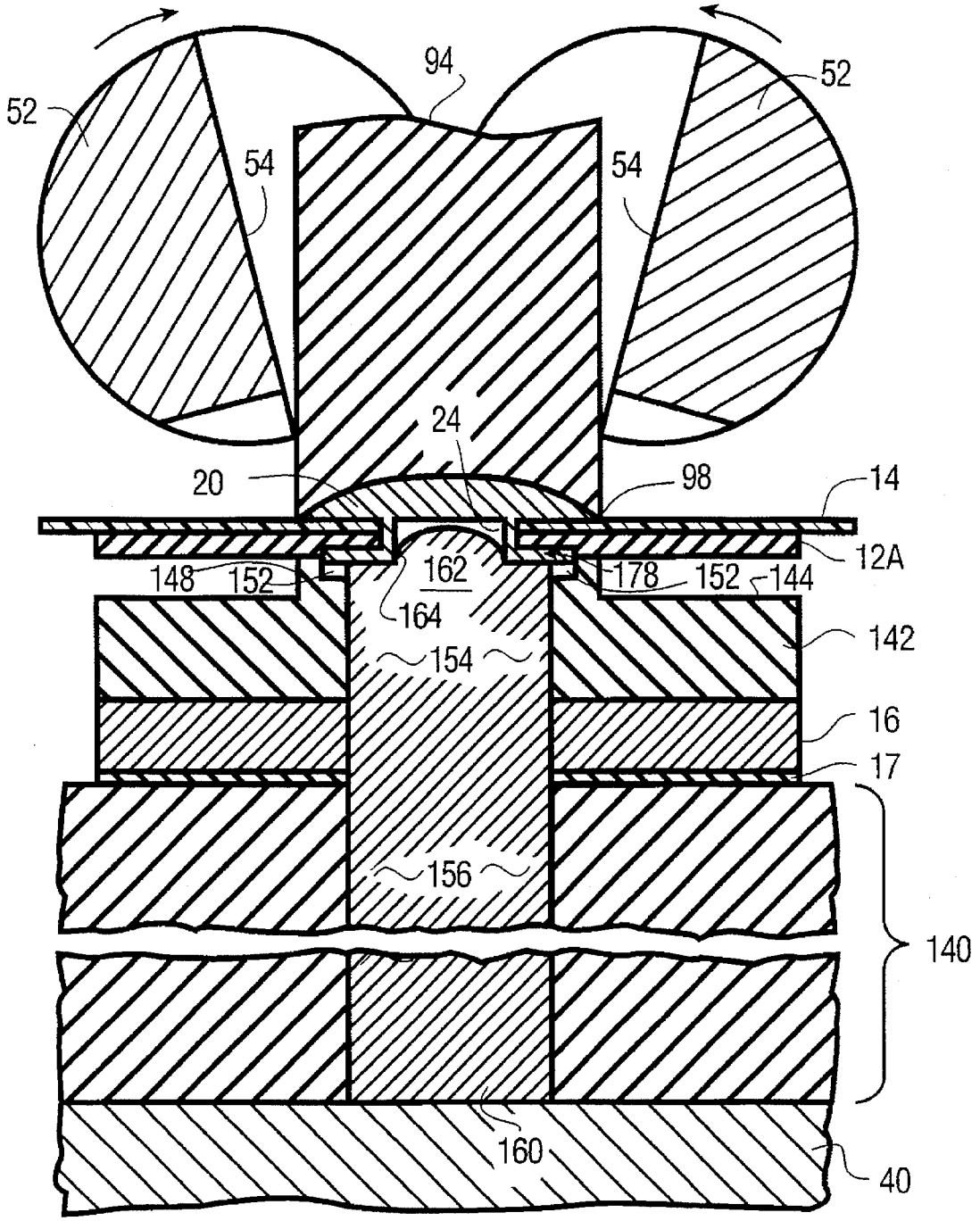
FIG. 13 is an isolated cross-sectional schematic view analogous to the view shown in FIG. 12 with with the drive shaft in a lowered position with the rivet having been press driven against the anvil and a second head having been press formed so as to mount the unified binder and ring assembly with the cover spine.
Figure 14:
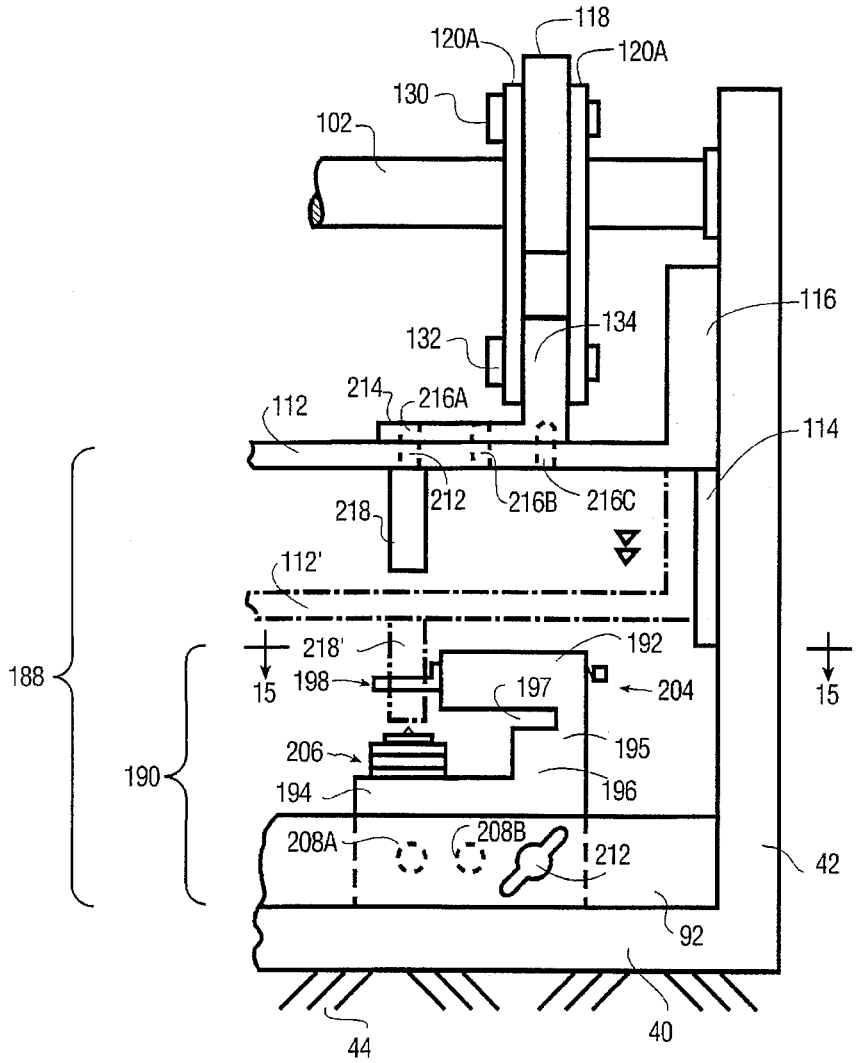
FIG. 14 is an isolated side view illustrating an modular rivet support unit that is horizontally adjustable together with a drive shaft that can be selectively adjusted relative to the position of the modular unit.

A pair of upper support blocks 46 positioned in horizontal spaced relationship are shown in FIGS. 1, 6, 7 9, 10 and 12. Each upper support block 46 is connected to the inner side surface 48 of side support walls 42 of support structure 38. Each upper support block 46 supports a rivet support platform 50 that in turn includes two adjoining semi-platforms 52, each being rotatable about a pivot 54 that is connected to upper support block 46. Semi-platforms 52 upon rotation towards one another as shown in FIGS. 12, 13, and 14 allow the release of rivet 18 for downward movement. Each semi-platform 52 has a planar surface 56 and an inner edge 58 that defines a semi-circular aperture 60 and each rivet support platform 50 further defines a central circular aperture 62 having a diameter slightly larger that the diameter of shank 22 of rivet 18 and smaller than the diameter of rivet head 20 so that when each rivet support platform 50 is supporting a rivet 18, shank 22 passes through circular aperture 62 and rivet 18 is held in place by rivet head 20 lying upon planar surface 56 when rivet support platform 50 is in a support position, that is, when planar surfaces 56 of semi-platforms 52 are oriented horizontally. The release position of rivet support platform 50 occurs when the adjoining planar surfaces 56 of semi-platforms 52 are oriented in generally facing planes. Each pivot 54 is generally parallel to the elongated lie of binder portion 12A when mounted under upper support block 46. Each semi-platform 52 is rotatable about each of its pivots 54 between the above-defined support and release positions. A coil spring 64 shown in FIGS. 7 and 8 biases each semi-platform 52 from the release position to the support position. Each coil spring 64 includes a coil 66 coiled around a coil rod 68 that is an extension of pivot 54 with one coil end secured to a stop 70 secured to coil rod 68 that strikes a stop surface 72 that is a portion of support structure 38.

A first keeper 74A prevents binder and ring assembly 12 and in particular binder portion 12A from lateral movement relative rivet support platforms 50. As shown in FIGS. 9 and 9A, binder portion 12A is positioned horizontally between circular apertures 62 in which rivets 18 are positioned in preparation for assembly of binder and ring assembly 12 with spine 16 of cover 14. In particular binder apertures 32 are positioned directly under circular apertures 62.

A second keeper 74B shown in FIGS. 9 and 9A is connected to support structure 38 prevents binder and ring assembly 12 and in particular binder portion 12A from transverse movement relative to rivet support platforms 50. Second keeper 74B includes two positioning blocks 76 each positioned proximately below each upper support block 46 that are connected to inner side surfaces 48 of support structure 38. The opposed ends 78 of binder portion 12A are in contact with the inner surfaces of positioning blocks 76 so that binder and ring assembly 12 is prevented from lateral movement.

Figure 5A:
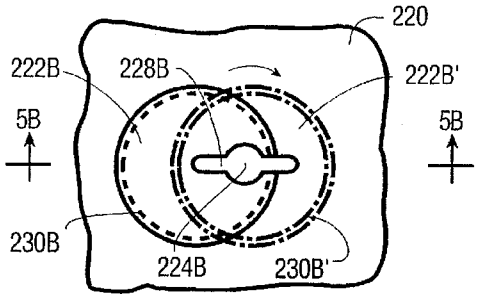
FIG. 5A is an isolated top view of a single dowel shown in FIG. 5.
Figure 5B:
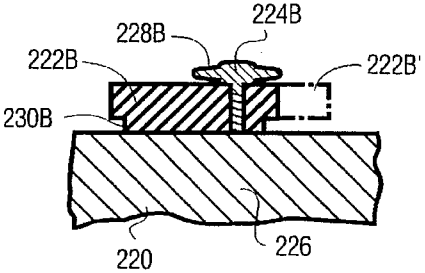
FIG. 5B is a sectional view taken through line 5B in FIG. 5A.
Figure 5:
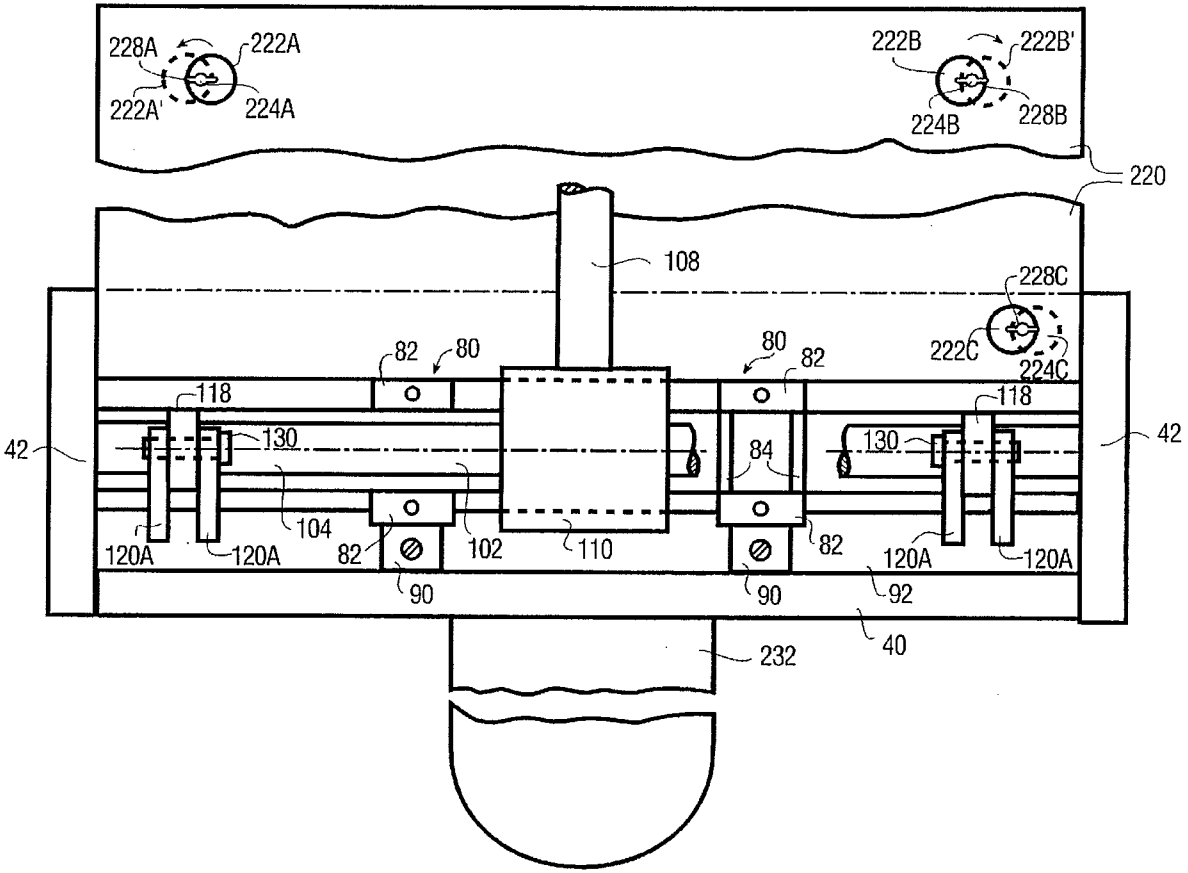
FIG. 5 is a top view of the apparatus shown in FIG. 1 with a mounting table partially shown.
Figure 7:
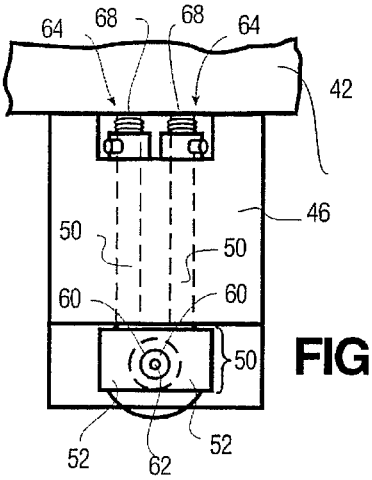
FIG. 7 is an isolated top view of a rivet support taken through line 7—7 of FIG. 6.

As shown in FIGS. 1, 5, and 9, second keeper 74B includes two locking support pieces 80 into which binder and ring assembly 12 is positioned so as to prevent lateral movement of binder and ring assembly 12 relative to upper support blocks 46. Each locking support piece 80 comprises two spaced cross-supports 82 lying transverse to the linear alignment of binder and ring assembly 12 and two spaced side-supports 84 connected to the top sides of cross-supports 82 and extending lateral to the linear alignment of binder and ring assembly 12. Side supports 84 have facing inner edges 86 spaced apart to the width 88 of binder portion 12A. Two spaced apart rectangular mounting ribs 90 lie transverse to the elongated lateral lie of binder portion 12A are in turn mounted upon a support member 92 rectangular in cross-section that extends between support structure side walls 42 and rests upon support structure base 40. Mounting ribs 90 have a cross-sectional width slightly greater than the distance between side-supports 84 of locking support pieces 80. Locking support pieces 80 are positioned upon mounting ribs 90 with the inner edges of cross-supports 82 positioned in contact with the outer sides of ribs 90 so that width 88 of binder portion 12A can be positioned between side supports 84 on top of side-supports 84. Locking support pieces 80 can be removed from mounting ribs 90 and replaced with alternative locking support pieces having side supports analogous to side supports 84 which are spaced farther apart from one another than side supports 84 described herein which are directed at the particular width 88 of binder portion 12A.

A third keeper 74C includes positioning blocks 76 connected to side support walls 42 of support structure 38 and spaced slightly below upper support blocks 46 so as to define recesses 91 for reception of cover spine 16. As shown in FIGS. 9 and 9A, third keeper 74C prevents lateral movement of cover spine 16 relative to binder portion 12A during the mounting process of connecting binder portion 12A with cover spine 16. In particular, inner side surfaces 48 of support structure 38 within recesses 91 act as stops for opposed ends 17 of cover spine 16.

Two vertical drive shafts 94 are positioned over rivet support platforms 50, in particular over each circular aperture 62 therein. Each drive shaft 94 is movable between raised and lowered positions, the raised position being shown in FIGS. 1, 6, 9, and 11, and the lowered position being shown in FIGS. 12 and 13. Each drive shaft 94 when moved from the raised position to the lowered position moves in a downward vertical direction. In the raised position each drive shaft 94 is spaced above each rivet support platform 50 and in particular over each rivet 18. In the lowered position each drive shaft 94 has terminated a downward stroke and has driven each rivet 18 vertically downwardly from its support position within each rivet support platform 50 to its release position free of each rivet support platform 50, and in particular has driven each rivet plain end 28 downwardly through cover spine 16 and through each aperture 32 of binder portion 12A. Each drive shaft 94 has upper and lower ends 96 and 98, respectively. Each shaft lower end 98 defines a central hollow 100 sized to receive the convex head 20 of a rivet 18.

Figure 6:
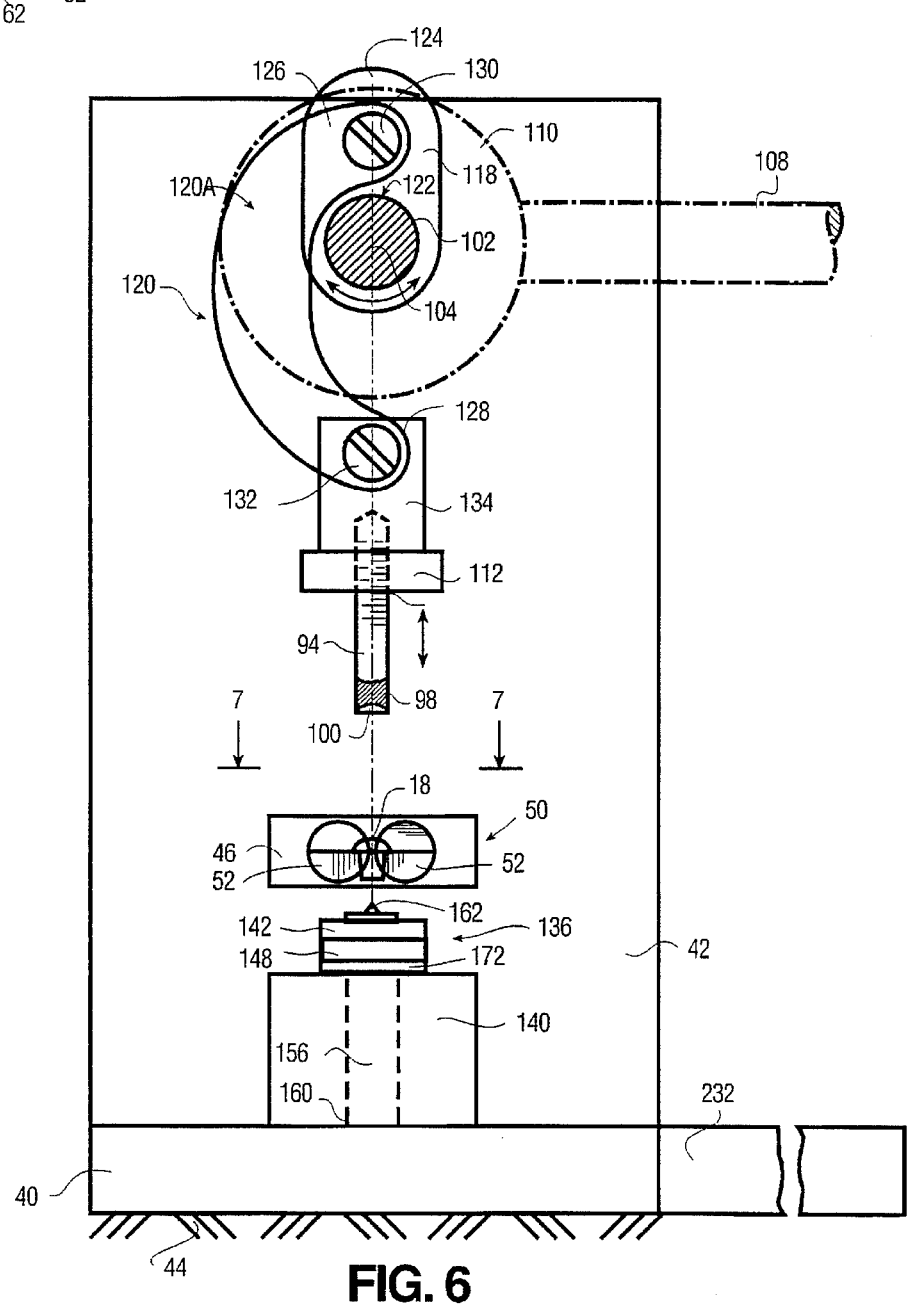
FIG. 6 is a sectional view taken through line 6—6 of FIG. 1 including a rivet resting on rivet support platforms with the drive mechanism and drive linkage in a raised position.

A horizontal cylindrical drive bar 102 is rotatable about an axis of rotation 104 and is rotatably connected to side support walls 42 and extends over and lateral to the elongated center of binder portion 12A as positioned in second keeper 74B. A drive linkage 106 shown in FIGS. 1, 5, 6, 9, and 12 is operatively connected to drive bar 102 and to vertical drive shafts 94. A hand lever 108 shown in FIGS. 1, 5, 6 (in phantom line), 7, and 12 (in phantom line) is operatively connected to drive bar 102 at hand lever base 110 at a perpendicular orientation relative to axis of rotation 104 and is rotatable about axis of rotation 104 upon pressure applied by an operator. Drive bar 102 and drive linkage 106 are movable between first and second drive positions in operative response to rotation of drive bar 102. The first drive position is when both drive shafts 94 are in a raised position as shown in FIGS. 1, 6, and 9. The second drive position is when both drive shafts 94 are in the lowered position as shown in FIG. 12.

As seen in FIGS. 1 and 9, a horizontal support member 112 extends below and lateral to drive bar 102. Drive shafts 94 are screwed into horizontal support member 112 and extend downwardly therefrom. Drive shafts 94 are preferably located directly below each of drive linkages 106. Vertical rails 114 are connected to the interior sides of side support walls 42. Rail grips 116 connected to opposed ends of horizontal support member 112 are slidably mounted around rails 114 so that horizontal support member 112 is vertically movable upwardly and downwardly.

Drive linkage 106 includes a pair of spaced apart first and second drive links 118 and 120, respectively. Second drive link 120 is structured as paired second link portions 120A that are here treated as one second drive link 120. Each first drive link 118 has opposed first link ends 122 and 124. Each second drive link 120 has opposed second link ends 126 and 128. First link end 122 is integral with cylindrical drive bar 102 and first link end 124 is rotatably connected at a first pivot 130 to second link end 126. Second link end 128 is rotatably connected by a second pivot 132 to a vertical bracket 134 connected to horizontal support member 112. Paired second link drive portions 120A are mounted to the opposed sides of both first drive link 118 and of bracket 134.

Each first and second drive links 118 and 120 are simultaneously movable to withdrawn and extended positions corresponding to the raised position of drive shafts 94 as shown in FIGS. 1, 6, 9, and 11 and the lowered positions of drive shafts 94 as shown in FIGS. 13 and 14, respectively. In the withdrawn position first pivot 130 is positioned above cylindrical drive bar 102 and in said extended position first pivot 130 is positioned below cylindrical drive bar 102. First drive link 118 has a first length and second drive link 120 has a second length, and in their extended position first and second drive links 118 and 120 have a total extended length which defines a limit on the downward movement of drive shafts 94 at the lowered position so as to negate the possibility of the operator exerting excessive force during the mounting process and damaging the apparatus.

A pair of metal anvils 136 receive rivet plain ends 28 and convert them into second rivet heads 138 upon termination of the downward stroke of drive shafts 94 at the extended position shown in FIG. 12 and particularly in FIG. 13. Upon forceful activation of hand lever 108 by the operator and simultaneous activation of drive linkage 106, drive shafts 94 drive rivet plain ends 28 through cover spine 16 and thereupon press rivet plain ends 28 through apertures 32 of binder portion 12A. Upon second rivet plain ends 28 reaching anvils 136 and upon first and second drive links 118 and 120 reaching their extended length, rivet plain ends 28 along with shank cylindrical walls 24 which are pressed against anvil support blocks 140 so as to form second rivet heads 138 at countersinks 34 of binder portion 12A thus securing binder and ring structure 12 to cover spine 16 between rivet convex heads 20 and second rivet heads 138.

Anvils 136 are located directly under rivet support platforms 50 and are supported by anvil support blocks 140 which in turn are supported by base 40 of support structure 38. Each anvil 136 includes a cylindrical first anvil portion 142 having a horizontal planar top surface 144. First anvil portion 142 defines a central bore having a bore cylindrical surface 146. An axially aligned vertical circular flange 148 spaced from bore cylindrical surface 146 extends vertically upwardly from top surface 144. A planar horizontal axially aligned ring top surface 150 located axially inwardly from flange 148 extends radially inwardly from circular flange 148 to bore cylindrical surface 146. Flange 148 and ring surface 150 define a circular recess 152.

Each anvil 136 further includes a second anvil portion 154 including a vertical cylindrical metal post 156 having a post top end 158 and a post bottom end 160 which is in bearing contact with the top surface of base 40 of support structure 38. Second anvil portion 154 includes a nipple 162 axially aligned with first anvil portion 142 and which protrudes upwardly from post top end 158. A horizontal ring surface 164 surrounds nipple 162 at post top end 158. Nipple 162 has an axially aligned circular base 166.

Figure 11:
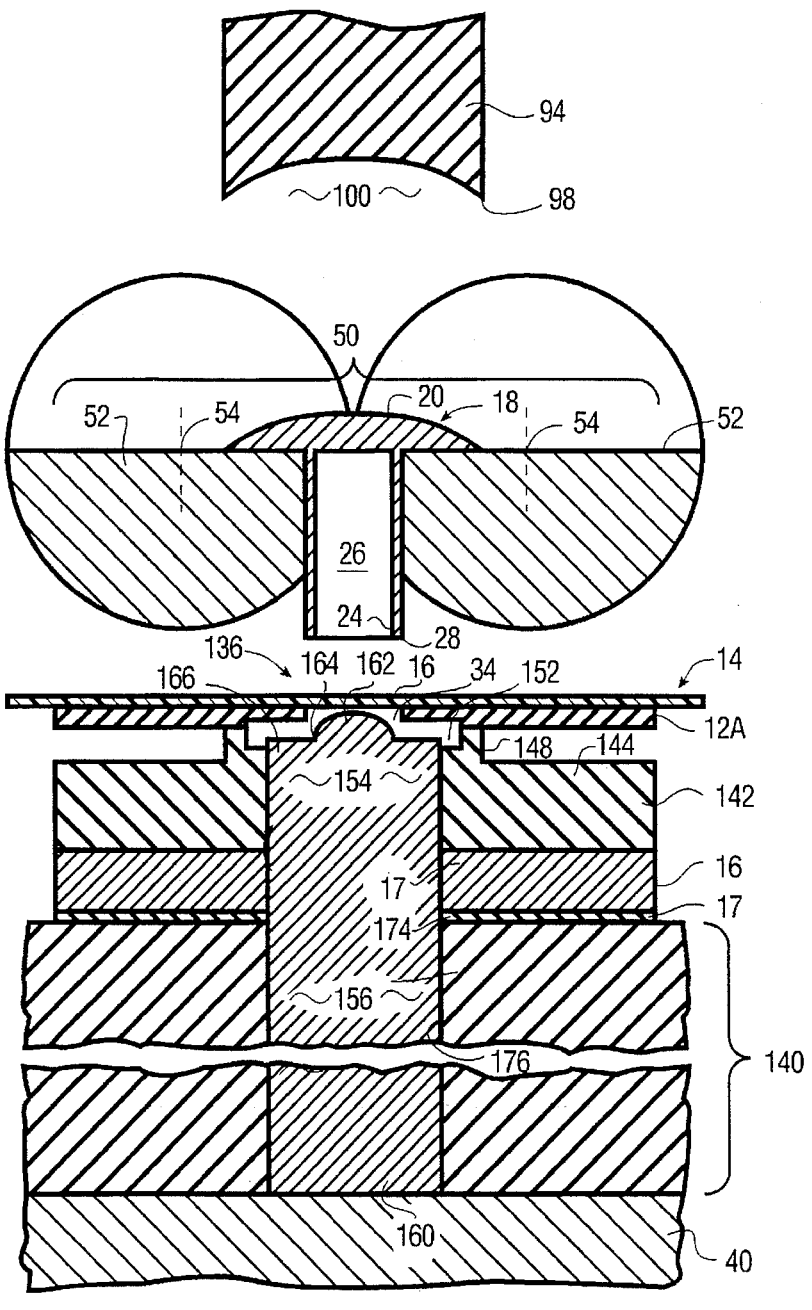
FIG. 11 is an isolated cross-sectional schematic view of a drive shaft in a raised position, a rivet support platform holding a rivet, a cover spine, a unified binder and ring assembly, and an anvil all taken from the view shown in FIG. 6.

As seen best in FIG. 11, rivet support platform 50 positions a rivet 18 with shank 22 extending through circular aperture 62 with the planar bottom side of rivet head 20 lying flush with planar surfaces 56 of semi-platforms 52. Shank cylindrical wall 24 is aligned with circular base 166 of nipple 162. Binder portion 12A lies over anvil 136 with binder portion outer side 36 in particular lying upon flanges 148, and nipple 162 lies within binder aperture 32. Cover 14 lies over binder portion 12A with cover spine 16 in particular lying over binder portion 12A.

A cylindrical shock absorber 168 made of a resilient material having a central cylindrical bore 170 lies directly under cylindrical first anvil portion 142. Post 156 of second anvil portion 154 passes through bore 170. A metal cylindrical bushing 172 having a cylindrical bore 174 lies directly under shock absorber 168 with post 156 passing through bore 174. Anvil support block 140 supports bushing 172. Anvil support block 140 defines a cylindrical bore 176 directly aligned with bores 170 and 174. Post 156 passes through bore 176. Anvil support block 140 lies upon metal base 40 of support structure 38. Post bottom end 160 is supported by base 40.

As best seen in FIGS. 12 and 13, when hand lever 108 is rotated by an operator, each vertical drive shaft 94 is driven vertically downwardly from the raised position to the lowered position. Drive shaft bottom hollow 100 is contoured to fit over rivet convex head 20, and once in contact with rivet 18 drive shaft 94 further acts to drive rivet 18 vertically downwardly until shank cylindrical wall 24 at rivet plain end 20 passes through cover spine 16 (cover paper removed from cover spine 16 not shown) and then through aperture 32. Rivet plain end 20 comes into pressing contact with anvil 136 particularly with circular base of second anvil portion 154 as nipple 162 is enveloped by shank hollow 26 so that the primary pressure from drive shaft 94 is applied by second anvil portion 154 is applied at shank cylindrical wall 24. Upon further pressure against rivet 18 by drive shaft 94, shank cylindrical wall 24 is pressed downwardly against nipple ring 164 and then radially outwardly away from nipple 162 into countersink 34 and finally into recess 152 so as to form a second rivet head 178 opposed to rivet head 20 with cover spine 16 and binder portion 12A being mounted together. The prior description of one anvil 136 applies likewise to both anvils 136, the mounting operation being simultaneous for both.

When drive shaft 94 is forced downwardly against rivet 18, the edges of rivet head 20 are pressed against the portions of semi-platforms 52 that are located radially inward towards the center of rivet support platform 50 relative to pivots 54 so that semi-platforms 52 rotate downwardly thus freeing rivet 18 from its position in circular aperture 62 and rivet support platform 50. Drive shaft 94 likewise presses semi-platforms 52 apart.

When the two rivets 18 have fully connected cover 14 and binder and ring assembly 12 together, the operator then pushes hand lever 108 in the opposite direction so as to rotate drive bar 102 likewise in the opposite direction thus causing drive linkage 106 to lift horizontal support member 112 upwardly. Drive shafts 94 are likewise lifted upwardly thus freeing semi-platforms 52 to be rotated back to their support position shown in FIGS. 6 and 11 by action of coil springs 64.

Figure 10:
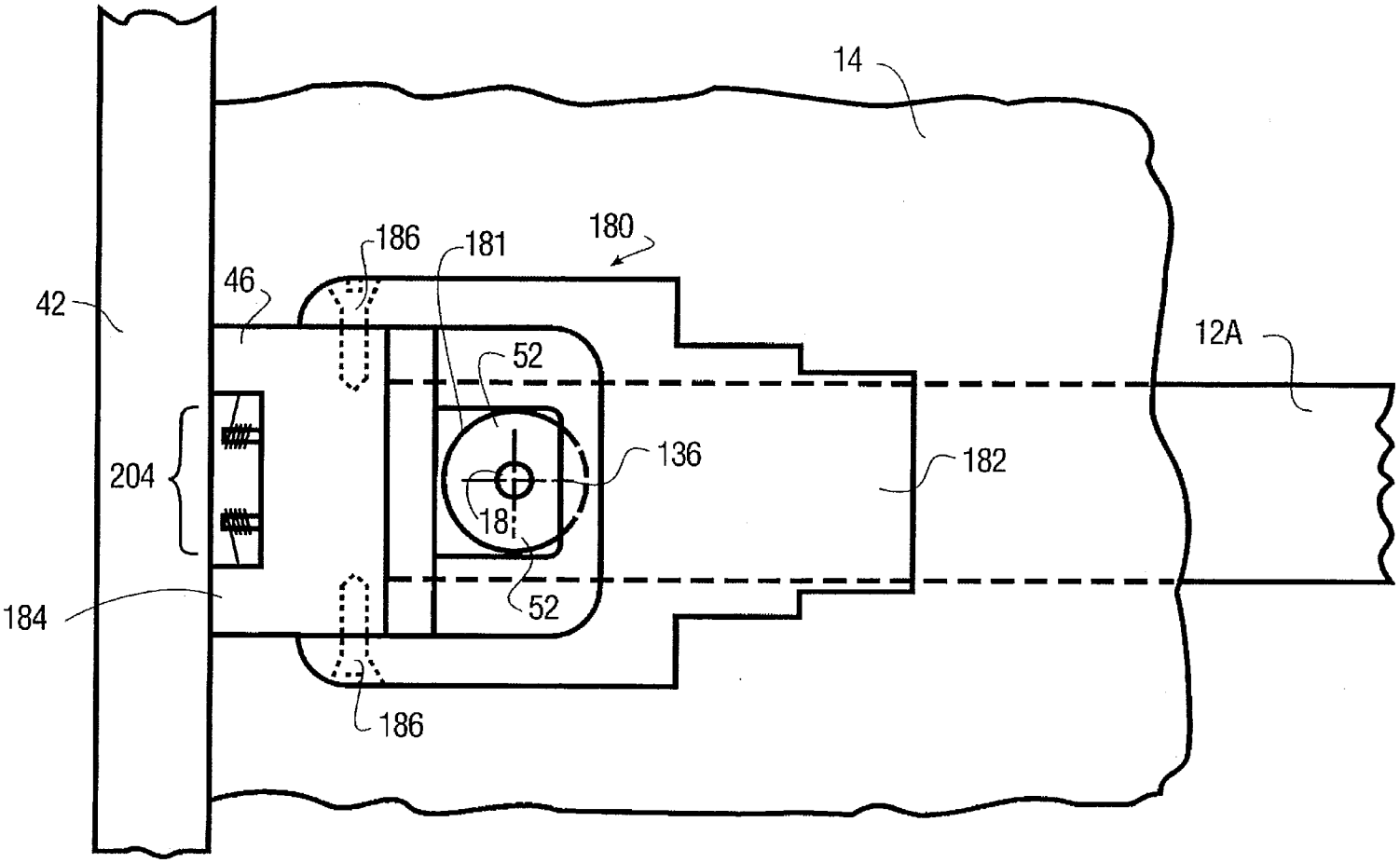
FIG. 10 is an isolated top view taken through line 11—11 of FIG. 10 showing a hold-down plate over a rivet support platform with a rivet thereon.

FIG. 9 and in particular FIG. 10 show two optional hold-down plates 180 that each have a clamp end 182 and an opposed end 184 that is rotatably attached to upper support blocks 46 by a pair of pivots 186 aligned transverse to the orientation of second keeper 74B and cover spine 16 and connected to upper support block 46. Each hold-down plate 180 is hand-movable about pivots 186 for movement between a lowered, or generally horizontal hold-down position, upon cover spine 16 and a raised position away from cover spine 16 as shown in FIG. 9 in solid line and a raised position as shown also in FIG. 9 as hold-down plate 180A in phantom line. In the lowered position clamp end 182 is positioned over cover spine 16 during the riveting operation, and in the raised position clamp end is spaced above cover spine 16 so as to allow easy removal of the riveted together cover 14 and binder and ring assembly 12 and placement of a new cover 14 and binder and ring assembly 12 and new rivet 18 into circular aperture 62 of rivet support platform 50 for the next riveting operation. Pivots 186 are pressure screwed into upper support blocks 46 so as to create a frictional lock between hold-down plate 180 and support blocks 46 in either the lowered or raised position. Each hold-down plate 180 defines an opening 181 directly over each of rivet support platforms 50.

An embodiment of two adjustable mounting units 188 provides means for the operator to select the distance between the two rivets 18. Each mounting unit 188 includes two modular bodies each of which as typified in the FIGS. 14, 15, 16, and 17 as modular body 190 includes an upper support block 192, an anvil support block 194 spaced below upper support block 192, a joining portion 195 between upper support block 192 and anvil support block 194, and a positioning block portion 196 between upper support block 192 and anvil support block 194 connected to joining portion 195. Positioning block portion 196 is spaced slightly below upper support block 192 so as to define a recess 179 for reception of cover spine 16. The opposed ends of binder portion 12A are in contact with positioning block portions 196 so that binder and ring assembly 12 is prevented from lateral movement relative to upper support blocks 192. The inner surface of joining portion 195 within recess 197 acts as a stop for opposed ends 17 of cover spine 16.

Each modular body 190 includes a rivet support platform 198 analogous to rivet support platform 50 described earlier for holding a rivet 18 that in turn includes two adjoining semi-platforms 200, each rotatable about a pivot 202 that is connected to a upper support block 192. A coil spring 204 biases each semi-platform 200 from the release position to the support position. Each modular body 190 further includes a metal anvil 206 analogous to anvil 136 described previously. Anvil 206 is located directly under rivet support platform 198 and is supported by anvil support block 194.

Figure 15:
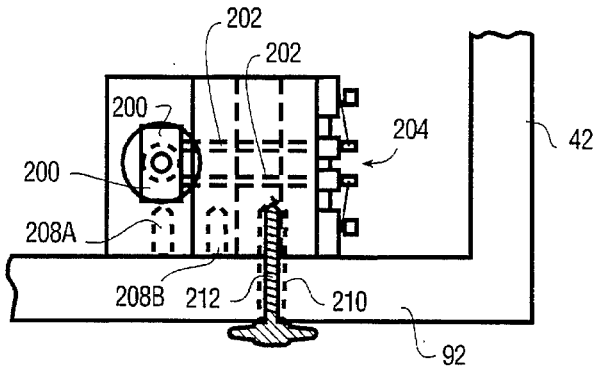
FIG. 15 is a top view taken through line 15—15 in FIG. 14.

Each modular body 190 and in particular anvil support block 194 lies upon base 40 of support structure 38 described previously and adjacent to horizontal support member 92 described previously. Anvil support block 194 defines three horizontal screw holes 208A, 208B, and 208C each of which can be aligned with a horizontal screw hole 210. Each modular body 190 can be slid along horizontal support member 92 and be selectively removably connected to horizontal support member 92 by a screw 212 that extends through screw hole 210 into any selected screw hole 208A, 208B, or 208C. FIGS. 14 and 15 show screw 212 extending into screw hole 208C for purposes of illustration.

Figure 16:
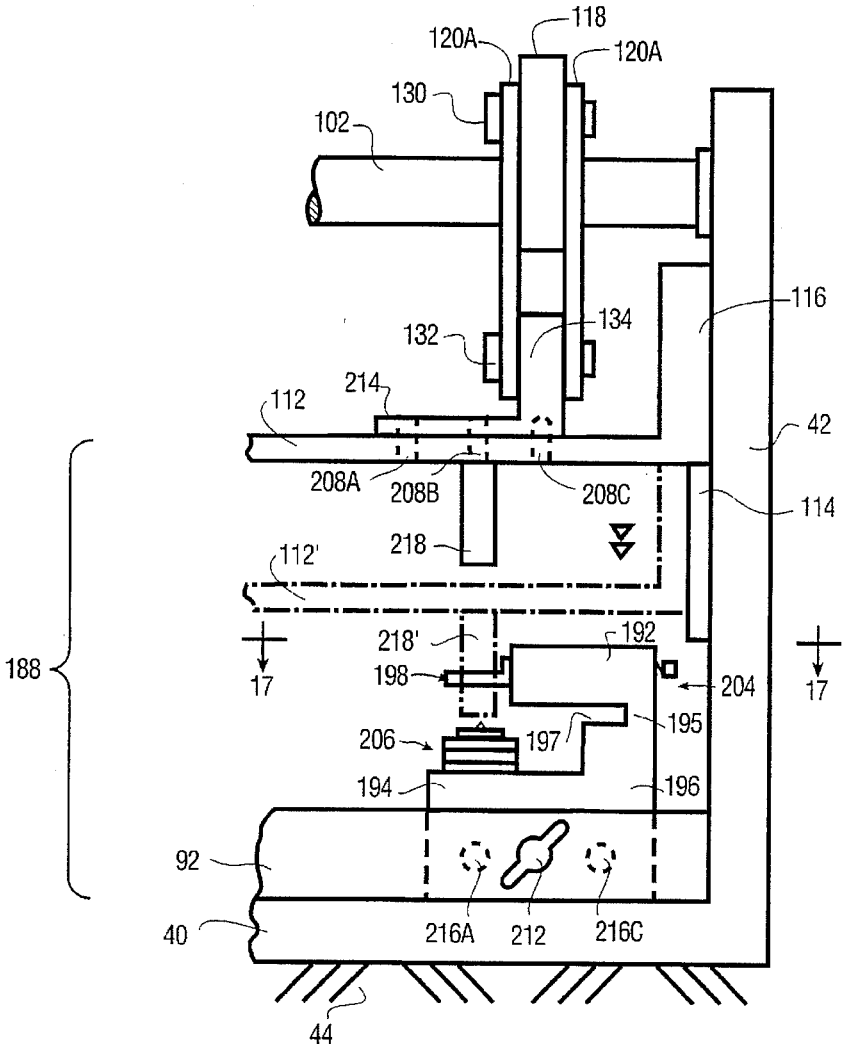
FIG. 16 is a top view similar to FIG. 16 with the modular unit moved to a different selected position than the position shown in FIGS. 15 and 16.
Figure 17:
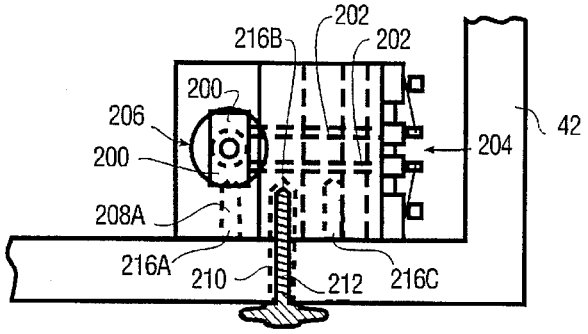
FIG. 17 is a top view taken through line 16—16 of FIG. 15.

The selected position shown in FIGS. 14 and 15 would result in rivets 18 being connected to a selected binder and cover at a closer distance that the selected position shown in FIGS. 16 and 17.

FIGS. 14 and 16 show a horizontal reinforcing plate 214 attached to the top of horizontal support member 112 that is integral with bracket 134 positioned between and connected by pivot 132 to second link paired portions 120A. Each mounting unit 188 further includes horizontal support member 112 together with reinforcing plate 216 previously described defining three screw holes 216A, 216B, and 216C. A drive shaft 218 has an upper end that is removably connected to horizontal support member 112 by being screw mounted into screw hole 216A that is shown in the raised position in FIG. 15 in direct alignment over and with rivet support platform 198 and anvil 206. Drive shaft 218 and horizontal support member 112 with drive linkage 106 are shown in a lowered position in FIG. 14 in phantom line as horizontal support member 112'.

FIGS. 16 and 17 show modular body 190 slid outwardly from the opposed modular body (not shown) towards side support wall 42 of support structure so as to enlarge the distance between the rivets securing the cover and the binder together. In particular, screw 212 is positioned in screw hole 216B. Drive shaft 218 is now positioned in screw hole 216B so that drive shaft 218 is in direct alignment with and over rivet support platform 198 and anvil 206. Drive shaft 218 and horizontal support member 112 with drive linkage 106 are shown in a lowered position in FIG. 16 in phantom line as horizontal support member 112'.

Although not illustrated, modular body 190 can be further slid outwardly from the opposed modular body so as further to enlarge the distance between the rivets securing the cover and the binder together. In particular, screw 212 can be positioned in screw hole 208B and drive shaft 218 can be positioned in screw hole 216C so that drive shaft 218 is in direct alignment with and over rivet support platform 198 and anvil 206.

FIGS. 5, 5A, 5B, and 6 show a horizontal mounting table 220 that is connected to the rear side of base 40 of support structure between side support walls 42 of support structure 38. Two cylindrical dowels 222A and 222B are positioned in parallel relationship to base 40 at a distance from base 40 and a third cylindrical dowel 222C is positioned nearer to base 40 than dowels 222A and 222B and with dowel 222B defines a line perpendicular to base 40. Each dowel 222A, 222B, and 222C is connected to table 220 at off-center pivots 224A, 224B, and 224C, respectively, positioned in screw holes in table 220 exemplified by screw hole 226 in FIG. 5B. Pivots 224A, 224B, and 224C can be hand loosened at pivot wings 228A, 228B, and 228C, respectively, and then rotated about their pivots 224A, 224B, and 224C to such illustrative positions as 222A', 222B' and 222C' as indicated in phantom line and then tightened. When a cover spine 16 is placed over anvils 136, one cover side 30 extends over table 220 and dowels 222A, 222B, and 222C are adjusted by rotation to new positions adjusting to the edges of cover 14 by rotation about pivots 224A, 224B, and 224C. Cylindrical grooves 230A, 230B, and 230C defined by dowels 222A, 222B, and 222C, respectively, receive and act as stops for the edges of cover sides 30 at which time pivots 224A, 224B, and 224C are tightened and cover 14 is stabilized during the riveting operation. FIGS. 5A and 5B show views of dowel 222B with pivot 224B, pivot wing 228B, rotated position of dowel 222B' having groove 230B' and screw hole 226 defined in the top portion of mounting table 220 with pivot 224B screwed therein.

FIGS. 1, 5, and 6 show a brace 232 connected to the central area of the front side of base 40 of support structure 38 extending horizontally perpendicular to the axis of rotation of drive bar 102 in a position that directly opposes hand lever 108 when hand lever 108 has been fully rotated about cylindrical drive bar 102 so as to activate drive linkage 106 and drive shafts 94 to the second drive position as shown in FIG. 6. The force applied by the operator to hand lever 108 is absorbed by brace 232 and in general apparatus 10 is maintained in a stable mode during operations.

The materials used for apparatus 10 can be of any durable material with the understanding that the most desirable material used throughout is an appropriate metal or metals. It is to be understood that the ring portion of the ring binder assembly fabricated with the present apparatus, a user can open the ring binder or close it to added or remove any number of perforated sheets within the capacity that the ring binder is capable of holding. The present apparatus lends itself to an inexpensive, highly efficient method of producing a reasonable number of ring binders with a short run production applicability particulary useful the field of desktop publishing or the like.

Although the present apparatus has been described in some detail by way of illustration and example for purposes of clarity and understanding, it will, of course, be understood that various changes and modifications of the parts without departing from the scope of the invention set forth in the following claims. For example, unitary binder and ring assembly 12 can be replaced by a separate binder without an attached ring assembly, which can be attached later.

We claim:

1. An apparatus for securing a binder having opposed binder ends and two spaced holes to the spine of a cover with at least two compressible rivets each rivet having a head, a cylindrical shank wall defining a hollow shank, and a plain end, comprising a support structure, rivet support means for holding the at least two rivets in horizontal spaced relationship in a support position for movement to a release position wherein the at least two rivets are freed for downward movement, said rivet support means being connected to said support structure, biasing means for returning said rivet support means from said release position to said support position, means for pressing the pair of rivets from said rivet support means in a downward vertical direction from said support position to said release position, said means for pressing being movable between raised and lowered positions, wherein in said raised position said means for pressing is spaced above said rivet support means and in said lowered position said means for pressing has terminated a downward stroke and has driven the plain ends of each of the rivets downwardly through the cover spine and the binder, drive means for moving said means for pressing between said raised and lowered positions, said drive means being connected to said support structure, lever means for moving said drive means between said raised and lowered positions, and lever means for moving said drive means between said raised and lowered positions, and anvil means for receiving and making the plain ends of the rivets into second heads upon termination of the downward stroke of said means for pressing to said lowered position, whereby the rivets secure the binder and the cover spine, said anvil means being located under said at least two rivet support means and connected to said support structure.

2. The apparatus according to claim 1, wherein said rivet support means includes at least two rivet support platforms, each rivet support platform including two semi-platforms, each semi-platform being pivotably attached to said support structure, each rivet support platform being rotatable between said support and release positions.

3. The apparatus according to claim 2, wherein each semi-platforms has a planar surface and an inner edge and defines a semi-circular aperture at said inner edge, wherein each said rivet support platform defines a central circular aperture having a diameter slightly larger that the thickness of the shank of the rivet and smaller than the head of the rivet when each said rivet support platform is in said support position, said support position being when said planar surfaces of said semi-platforms are oriented horizontally and said release position being when said planar surfaces of said semi-platforms are oriented in generally facing planes.

4. The apparatus according to claim 3, further including a pivot attached to said support structure for each said semi-platform, each said pivot being lateral to said keeper means, each of said semi-platforms being rotatable about each of said pivots between said support and release positions, and wherein said biasing means includes two coil springs, each coil spring being connected connected to each of said pivots and including rotational limit stops, said support structure including stop surfaces for said stops.

5. The apparatus according to claim 3, wherein said means for pressing includes a vertical drive shaft positioned over each of said circular aperture, said drive shaft being operatively connected to said drive means, said drive shaft being movable between said raised and lowered positions.

6. The apparatus according to claim 5, wherein each said drive shaft has an upper end and a lower end, said upper end being operatively connected to said drive means and said lower end defining a central hollow being sized to receive the head of one of the at least two rivets mounted in said aperture of said support platform.

7. The apparatus according to claim 6, wherein said anvil means includes at least two anvils, each anvil including a nipple protruding upwardly from said anvil axially aligned with said central circular aperture of each said rivet support platform, said nipple having an axially aligned nipple circular base, the cylindrical wall of the rivet shank being aligned with said nipple circular base when the rivet is in said rivet support platform and said nipple being positioned within the shank hollow when said drive shaft is in said lowered position.

8. The apparatus of claim 7, wherein each said anvil further includes a circular flange spaced from and axially aligned with said nipple, said nipple circular base and said flange defining recess means for receiving the shank wall and forming a second rivet head when said drive shaft is in said lowered position.

9. The apparatus according to claim 8, wherein each said anvil further includes a cylindrical first anvil portion defining a central cylindrical bore having a bore rim and includes said circular flange axially aligned around said bore rim.

10. The apparatus according to claim 9, wherein each said anvil further includes a second anvil portion having a vertical cylindrical post positioned within said bore of said first anvil portion, said post having a post top end and a post bottom end, said post bottom end being connected to said support structure, said post top end having said nipple protruding upwardly axially aligned with said post, said post bottom end being in contact with said bottom wall of said support structure.

11. The apparatus according to claim 10, further including a cylindrical shock absorber defining a shock absorber central bore mounted within said bore of said first anvil portion adjacent to said first anvil portion.

12. The apparatus according to claim 11, further including a cylindrical bushing defining a bushing central bore mounted within said bore of said first anvil portion and adjacent to said shock absorber.

13. The apparatus according to claim 12, wherein each said anvil includes an anvil support block, said anvil support block supporting said bushing and further being supported by said bottom wall of said support structure, said anvil support block defining a cylindrical anvil support block bore, said post of said second anvil portion being positioned in said anvil support block bore.

14. The apparatus according to claim 1, wherein said support structure includes a pair of vertical side support walls, and wherein said drive means includes a horizontal drive bar having an axis of rotation rotatably connected to said side support walls and extending over said rivet support means, said drive means further including at least one drive linkage operatively connected to said drive bar and to said drive shafts, said drive linkage being movable between first and second drive positions in operative response to rotation of said drive bar, said first drive position being when said at least two shafts are in said raised position and said second drive position being when said at least two shafts are in said lowered position.

15. The drive apparatus according to claim 14, further including a drive lever operatively connected to said drive bar at a perpendicular orientation relative to the axis of rotation of said drive bar, said drive lever being rotatable about said axis of rotation of said drive bar, wherein said drive bar is rotated upon rotation of said drive lever by an operator.

16. The apparatus according to claim 15, further including a horizontal support member positioned below said drive bar and connected to said side support walls, and wherein said at least one drive linkage includes first and second drive links, said first drive link having opposed first link ends and said second drive link having opposed second link ends, one of said first link ends being connected to said drive bar and the other of said first link ends being rotatably connected at a first pivot to one of said second link ends, and the other of said second link ends being rotatably connected at a second pivot to said horizontal support member.

17. The apparatus according to claim 16, wherein said first and second drive links are movable to withdrawn and extended positions corresponding to said raised and lowered positions of said drive means, respectively, wherein in said withdrawn position, said first pivot is positioned above said horizontal drive bar and in said extended position said first pivot is positioned below said horizontal drive bar.

18. The apparatus according to claim 17, wherein said first drive link has a first length and said second drive link has a second length, and in said extended position said first and second drive links have a total extended length which defines a limit on the downward movement of said at least two shafts at said lowered position.

19. The apparatus according to claim 16, further including a vertical rails connected to each of said side support walls and a rail grip sliding mounted to each of said rails, said rail grips being connected to said horizontal support member, said horizontal support member being movable vertically upwardly and downwardly in response to movement of said drive linkage between said first and second drive positions, respectively, in operative response to rotation of said drive bar.

20. The apparatus according to claim 14, wherein said at least one drive linkage is at least two drive linkages.

21. The apparatus according to claim 1, further including first keeper means for holding the binder in a horizontal alignment with the two binder holes under the rivet support means and for preventing the binder from lateral movement relative to said rivet support means in preparation for assembly of the binder with the spine of the cover, said first keeper means being positioned adjacent to said rivet support means and connected to said support structure.

22. The apparatus according to claim 1, further including second keeper means for preventing the binder from transverse movement and holding the two binder holes under the rivet support means in preparation for assembly of the binder with the cover spine.

23. The apparatus according to claim 22, wherein said second keeper means includes at least one spaced support rib and one locking support piece having two spaced cross-supports having top sides lying transverse to the linear alignment said anvil means and two spaced side-supports connected to said top sides and extending transverse to the linear alignment said anvil means, said side supports having facing inner edges spaced apart to a distance, whereby when the width of the binder has a width slightly less than said distance, the binder can be mounted onto said locking support piece between said side supports.

24. The apparatus according to claim 23, wherein said at least one rib support is a plurality of spaced rib supports and said one locking support piece is a plurality of locking support pieces mounted upon said plurality of spaced rib supports.

25. The apparatus according to claim 23, wherein said one locking support piece is removably mounted upon said at least one rib support.

26. The apparatus according to claim 1, further including third keeper means for preventing the cover from lateral movement in preparation for assembly of the binder with the cover spine, said third keeper means being associated with said support structure.

27. The apparatus according to claim 1, further including table means for holding the cover sides of the cover, said table means being connected to said support structure.

28. The apparatus according to claim 27, further including fourth keeper means for preventing the cover from both lateral and transverse movement during mounting operations, said fourth keeper means being mounted upon said table means.

29. The apparatus according to claim 1, further including a hold-down means for keeping the spine of the folder over said at least two rivet support means, said hold-down means being positioned over said rivet support means and being connected to said support structure.

30. The apparatus according to claim 29, wherein said hold-down means includes a flat member attached to pivots connected to said support structure for movement between a generally horizontal hold-down position upon the cover spine during mounting operations and a raised position away from the cover spine upon completion of mounting operations, said flat member being positioned over said rivet support means and defining an opening directly over said rivet support means.

31. The apparatus according to claim 2, wherein said rivet support means includes a plurality of rivet support platforms.

32. The apparatus according to claim 1, further including means for bracing the apparatus as said lever means is operated to move said drive means from said raised position to said lowered position, said means for bracing being connected to said support structure.

33. The apparatus according to claim 1, further including modular support means for mounting said rivet support means and said anvil means together in a single unit movable relative to said support structure.

34. The apparatus according to claim 33, wherein said modular support means and said support structure includes adjustable means for securing said modular support means to said support structure at any of a plurality of selected modular support positions wherein the at least two rivets are positioned at selected distances apart.

35. The apparatus according to claim 34, wherein said means for pressing includes a vertical drive shaft positioned over said rivet support means and said anvil means at each of said selected positions, said means for pressing including means for mounting said vertical drive shaft to any of a plurality of selected shaft positions relative to the plurality of said selected modular support positions wherein said drive shaft is located over said rivet support means and said anvil means.

* * * * *